US006295678B1

(12) United States Patent
Jonsson et al.

(10) Patent No.: US 6,295,678 B1
(45) Date of Patent: Oct. 2, 2001

(54) METHOD FOR PRE-BALANCING A ROTATING DRUM HAVING A TEMPORARILY SHIFTING UNBALANCE

(75) Inventors: Jöakim Jonsson, Hisings Backa; Hans Lindell, Säve, both of (SE)

(73) Assignee: SKF Autobalance Systems AB, Gothenburg (SE)

( * ) Notice: Subject to any disclaimer, the term of this patent is extended or adjusted under 35 U.S.C. 154(b) by 0 days.

(21) Appl. No.: 09/420,790

(22) Filed: Oct. 19, 1999

(30) Foreign Application Priority Data

Oct. 19, 1998 (SE) ..... 9803567

(51) Int. Cl.[7] ..... D06F 37/22

(52) U.S. Cl. ..... 8/159; 68/23.2; 210/144; 74/573 R

(58) Field of Search ..... 8/158, 159; 68/23.2, 68/23.3; 210/144, 363, 364; 74/573 F, 573 R

(56) References Cited

U.S. PATENT DOCUMENTS

| | | | | |
|---|---|---|---|---|
| 2,984,094 | * | 5/1961 | Belaieff | 68/23.2 |
| 3,683,647 | * | 8/1972 | Coshow | 68/23.2 |
| 4,433,592 | * | 2/1984 | Tatsumi et al. | 210/144 |
| 5,345,792 | * | 9/1994 | Farrington et al. | 68/23.2 |
| 5,460,017 | * | 10/1995 | Taylor | 68/23.2 |
| 5,806,349 | * | 9/1998 | Kim et al. | 68/23.2 |
| 5,813,253 | * | 9/1998 | Uhlin | 68/23.2 |
| 5,857,360 | * | 1/1999 | Kim et al. | 68/23.2 |
| 5,916,274 | * | 6/1999 | Lee et al. | 68/23.2 |
| 6,082,151 | * | 7/2000 | Wierzba et al. | 68/23.2 |

FOREIGN PATENT DOCUMENTS

| | | | | |
|---|---|---|---|---|
| 492238 | * | 4/1953 | (CA) | 68/23.2 |
| 0 810 316 | | 12/1997 | (EP) . | |
| 52-62977 | * | 5/1977 | (JP) | 68/23.2 |
| 54-140064 | * | 10/1979 | (JP) . | |
| 146796 | * | 2/1989 | (SU) | 68/23.2 |

* cited by examiner

*Primary Examiner*—Frankie L. Stinson
(74) *Attorney, Agent, or Firm*—Burns, Doane, Swecker & Mathis, L.L.P.

(57) ABSTRACT

The process for making an automatic balancing unit outbalance an unbalance condition in a rotating system, particularly a clothes washing machine with an outer casing an a suspended oscillating washing assembly comprising a wash tub, a cylindrically-shaped perforated drum housed in said tub and capable of rotating in the interior thereof about the axis of the cylinder during washing and spin-extraction, a motor capable of rotatably driving said drum at various speeds and provided with accessory means that are firmly associated with said tub, said drum being connected to said automatic balancing unit formed by at least one annular hollow body, forming a sealed closed-loop configuration and being mounted integrally with said cylindrical drum with their axis coinciding with the rotational axis of said perforated drum, and a plurality of moving masses capable of freely moving in a liquid filled in said hollow body, and which process incorporates that before at least a spin-extraction phase, the drum is driven to rotate in a continuous manner at a variable, relatively low speed in a single and same direction of rotation, wherein the frequency of said rotation is lower than the frequencies of translational eigen modes perpendicular to the rotational axis of the drum of said oscillating washing assembly, but anyway sufficient in view of causing the washload in the drum to keep adhering against the inner peripheral surface of the drum, wherein, for giving full repetitiveness to the outbalancing effect, minimizing any stiff body movements in the suspended assembly within the range of the actual speed variations around the distribution speed.

6 Claims, No Drawings

METHOD FOR PRE-BALANCING A ROTATING DRUM HAVING A TEMPORARILY SHIFTING UNBALANCE

BACKGROUND OF THE INVENTION

The present invention relates to a method for dynamically balancing a rotating drum, such as a washing machine drum, by means of an automatic balancing device comprising at least one annular hollow body secured to said drum and a plurality of balancing bodies freely displaceable within said hollow body. During rotation of the rotating drum these balancing bodies move to compensate for unbalance in the system, by arranging themselves in positions counteracting the unbalance forces.

By such arrangements it is possible to achieve a quite effective balancing function when the rotating drum has reached its supercritical rotary speed, but during starting and acceleration sequences, i.e. at subcritical speeds, there still remains unbalance of such a magnitude, that it can be unacceptable for many applications.

This is particularly, but not exclusively, the case involving clothes washing machines, wherein such automatic balancing devices give a real balancing effect only during the spin-drying phase, but not during periods of normal washing.

This problem is the basis for EP-A-0 810 316 which describes a clothes washing machine with an outer casing and a suspended oscillating washing assembly comprising: a wash tub, a cylindrically shaped perforated drum housed in said tub and capable of rotating in the interior thereof about the axis of the cylinder during washing and spin-extraction, a motor capable of rotatably driving said drum at various speeds and provided with accessory means that are firmly associated with said tub, said drum being provided with a dynamic balancing arrangement formed by a plurality of annular hollow bodies with preferably a rectangular shaped cross-section, said bodies forming sealed closed-loop configurations and being mounted integrally with said cylindrical drum with their axes substantially coinciding with the rotational axis of said perforated drum, and a plurality of moving masses capable of freely moving in a liquid of a definite viscosity filled in said hollow bodies, and which is characterized in that before at least a spin-drying phase, the drum is driven to rotate in a continuous manner at a variable, relatively low speed in a single direction of rotation, wherein the frequency of said rotation is lower than the frequency of resonance of said oscillating washing assembly, but anyway sufficient in view of causing the washload in the drum to keep adhering against the inner peripheral surface of the drum.

Due to these features it is alleged that the balancing device is capable of effecting balancing during all the rotational phases undergone by the rotary drum with its washload contained therein.

The solution presented in EP-A-0 810 316, the disclosure of which being incorporated herein by reference, only takes into account the forces caused by the rotational speed variations, and it has been found that this is only correct under specific circumstances, which means that further conditions must be satisfied for ascertaining that balancing effect is obtained over all speed ranges every time.

SUMMARY OF THE INVENTION

The purpose of the present invention is to propose a method, which also takes into account the counteracting forces generated as a consequence of the sub-critical motions of the suspended assembly, and where these forces must be smaller than those caused by the desired variations in the rotational speed, for permitting the mentioned principle to work, and this is achieved by minimizing any stiff body movements of the suspended assembly within the range of the actual speed variations around the distribution speed in order to give full repetitiveness to the outbalancing effect.

If these further conditions are fulfilled together with those mentioned in the above mentioned EP-A-0 810 316 it has been found that a balancing effect can be achieved every time and also under certain sub-critical speeds.

With this in mind it is evident that the balancing process which is described in the claims of EP-A-0 810 316 is not fully repetitive under the conditions described in this publication.

Pre-balancing by means of balancing bodies (usually balls) in a washing machine means that an attempt is made to give the balls a balanced position in a speed range in which balancing in an automatic balancing unit is normally not achieved.

It is usually considered that a rotary system shall have passed its first resonance frequency for permitting the automatic balancing function to come into effect. The reason that it operates in the super-critical range is that the phase angle between the unbalance and the geometrical center of the system is close to 180° related to the axis of rotation. The phase angle in this case is a definition of how the direction of the force caused by an unbalance is related to the direction of motion for the rotary system.

When studying a washing machine drum, e.g., that rotates about a horizontal axis, we will find that:

- prior to resonance there will be a phase angle which is close to 0°, which means that when the unbalance is positioned at the bottom of the drum, the suspended tub assembly is at its bottom position, and when the unbalance is at the top the suspended tub assembly will be at its highest position.
- at resonance, the phase angle is 90°, whereby the suspended assembly is situated towards the right hand side (or the left hand side) when the unbalance is at the bottom; when the unbalance is situated at the right hand side, then the suspended assembly is in its top (bottom) position.
- above the resonance the phase angle is close to 180°, whereby the suspended assembly is at the top when unbalance is at the bottom, and when the unbalance is at top the suspended assembly is at its bottom position.

The balls of the automatic balancing unit move together with the drum, which means that if the unbalance is at the bottom, then the drum is in its highest position and the balls strive upwards—the balls will outbalance the unbalance.

At pre-balancing there occurs a different physical phenomena, which has nothing to do with the phase angle. The physical phenomena which makes the pre-balancing work is to be found in the fact that when we again study the washing machine, we can establish that it has a drum which rotates with washload (representing an unbalance). When the unbalance is situated at the bottom and shall be lifted to the top of the drum, the required potential energy is taken from the speed of revolution of the drum. It also can be supposed that the torque supplied from the motor regarded as an average over a number of cycles is equal to the losses in order to keep the rotational speed of the drum at a constant value, seen as a main value over an extended number of revolutions. This means that the rotational speed of the drum is reduced when the washload (the unbalance) is pulled upwards and it accelerates when the washload is moving downwards.

If, hypothetically, the drum were non-rotating with the washload disposed at the top position, then the balls would roll down and position themselves at the bottom of the drum, which would give the desired reduction of the unbalance. The problem here is that also the washload will fall down if the drum stands still, which means that we should instead get an increased unbalance. Thus it is desirable that the washload is "more often" at the top than at the bottom thus that the balls will have time to roll "downwards". The washload will stay in its position relative to the drum when the centripetal acceleration becomes bigger than the acceleration due to gravity, and if the friction between drum and washload is sufficient to prevent the washload from sliding down, this break point will mostly occur around 50 rpm for domestic appliances.

According to this discussion the drum will move at its slowest speed when the washload (the unbalance) is at the top, which means that the unbalance is positioned a longer time at its top position than at its bottom position, and thereby the balls will have more time to roll downwards and thereby to counteract the unbalance. This time difference is what is referred to above as "more often", i.e. the effect aimed at is reached in this manner.

The pre-balancing will function in the best manner if the drum were absolutely rigidly constricted against non-rotary motions, as the balls and the unbalance thereby will be able to operate without disturbance. In the case of a washing machine it is however not possible to cause the drum to be absolutely rigidly constricted, and there will always occur non-rotary motions of the drum which cause the balls to be influenced by forces generated in accordance with the theory for automatic balancing, whereby the balls strive to follow the motions of the drum. In order to ascertain that the drum moves as little as possible (to minimize the forces generated according to the theory for automatic balancing), it is thus necessary to clear the rotational speed area at which the pre-balancing is effected from movements, which would otherwise increase the motions, or alternatively to dampen certain movements.

The stiff body movements in vertical direction are normally well damped in a washing machine, whereas the movements in horizontal direction are less well damped, and the damping of dynamic movements is less pronounced. With dynamic movement, it is understood the type of displacements generated by dynamic unbalances.

The aim is to create a frequency range (rotational speed) in which the washing machine drum can work for forming the required rotational speed variation and the minimized stiff body motion, which together give the desired effect, that the unbalance is reduced even though the resonance rotational speed has not been reached, and this is obtained by increasing the force transfer from the suspended assembly to the outer casing. This can be effected in different manners, i.e. by increasing the damping effect, either by friction increasing layers or with viscous damping systems. The increased force transfer can also be obtained by substituting one or more springs or resilient systems normally present between suspended assembly and outer casing for stiffer springs or providing further such stiffer springs or similar resilient systems. Similar results can also be obtained by increasing the mass of suspended systems, e.g., by additional weights or the like. It has proven itself that a good result is obtained by giving the system a maximum displacement amplitude of 1.5 times the distance between the geometrical center and the center of gravity of the oscillating washing assembly. Although this is not a set limit.

It is also important that the dynamic movement is minimized as much as possible. Such minimizing of the dynamic movements is done in today's washing machines, but for obtaining a good result it has proven itself that this movement is minimized further than is the case in today's washing machines, and also this is effected in the manners described above for increasing the force transfer. Also these dynamic movements can be minimized by ascertaining a low degree of mode coupling between the translational and dynamic displacement modes.

By redesigning dampers and springs as to position and value it is possible to move the resonances out from the rotational speed range at which pre-balancing shall be done, thereby reducing rotational motions and horizontal motions thus that this is obtained.

The invention is not limited to the embodiment described but can be varied and modified within the scope of the accompanying claims.

What is claimed is:

1. A process for making an automatic balancing unit outbalance an unbalance condition in a rotating system, particularly a clothes washing machine with an outer casing and a suspended oscillating washing assembly comprising a wash tub, a cylindrically-shaped perforated drum housed in said tub and capable of rotating in the interior thereof about the axis of the cylinder during washing and spin-extraction, a motor capable of rotatably driving said drum at various speeds and provided with accessory means that are firmly associated with said tub, said drum being connected to said automatic balancing unit formed by at least one annular hollow body, forming a sealed closed-loop configuration and being mounted integrally with said cylindrical drum and their axis coinciding with the rotational axis of said perforated drum, and a plurality of moving masses capable of freely moving in said hollow body, and which process incorporates that before at least a spin-extraction phase, the drum is driven to rotate in a continuous manner at a variable, relatively low speed in a single and same direction of rotation, wherein the frequency of said rotation is lower than the frequencies of translational eigen modes perpendicular to the rotational axis of the drum of said oscillating washing assembly, but anyway sufficient in view of causing the washload in the drum to keep adhering against the inner peripheral surface of the drum, characterized in minimizing any stiff body movements in the suspended assembly within the range of the actual speed variations around the distribution speed for giving full repetitiveness to the outbalancing effect.

2. The process according to claim 1, characterizing minimizing the stiff body movements by increasing the force transfer to the outer casing, for a given displacement amplitude.

3. The process according claim 1, characterized in, minimizing the stiff body movements by providing increased damping between the suspended assembly and the outer casing.

4. The process according to claim 1, characterized in, minimizing the stiff body movements by providing stiff springs between the suspended assembly and the outer casing.

5. The process according to claim 1, characterized in, minimizing the stiff body movements by giving the suspended assembly increased mass.

6. The process according to claim 1, characterized in, minimizing the stiff body movements by providing increased damping and stiff springs between the suspended assembly and the outer casing, and/or by giving the suspended assembly increased mass.

* * * * *